US005275899A

United States Patent [19]

Shimazu et al.

[11] Patent Number: 5,275,899

[45] Date of Patent: Jan. 4, 1994

[54] PHOTOCONDUCTIVE COMPOSITION

[75] Inventors: Ken-ichi Shimazu, Briarcliff Manor, N.Y.; Jayanti S. Patel, Fairlawn; Nishith V. Merchant, Palisades Park, both of N.J.

[73] Assignee: Sun Chemical Corporation, Fort Lee, N.J.

[21] Appl. No.: 867,846

[22] Filed: Apr. 13, 1992

[51] Int. Cl.[5] ..... G03G 5/06

[52] U.S. Cl. ..... 430/72; 430/56; 430/74; 430/77; 430/78

[58] Field of Search ..... 430/56, 72, 74, 77, 430/78

[56] References Cited

U.S. PATENT DOCUMENTS 4,741,983 5/1988 Skuby ..... 430/93

4,868,079 9/1989 Khe ..... 430/72

FOREIGN PATENT DOCUMENTS 216160 8/1990 Japan .

*Primary Examiner*—Roland Martin

*Attorney, Agent, or Firm*—Jack Matalon

[57] ABSTRACT

Photoconductive compositions useful in the fabrication of digital, laser-imaged offset printing plates. The compositions comprise a mixture of (a) an infrared-sensitive organic photoconductor sensitive to light in the wavelength range of 700–9090 nm; (b) a visible light-sensitive organic photoconductor sensitive to light in the wavelength range of 400–700 nm; (c) an ultraviolet-sensitive organic photoconductor sensitive to light in the wavelength range of 300–400 nm; and (d) a binder.

10 Claims, 1 Drawing Sheet

FIGURE
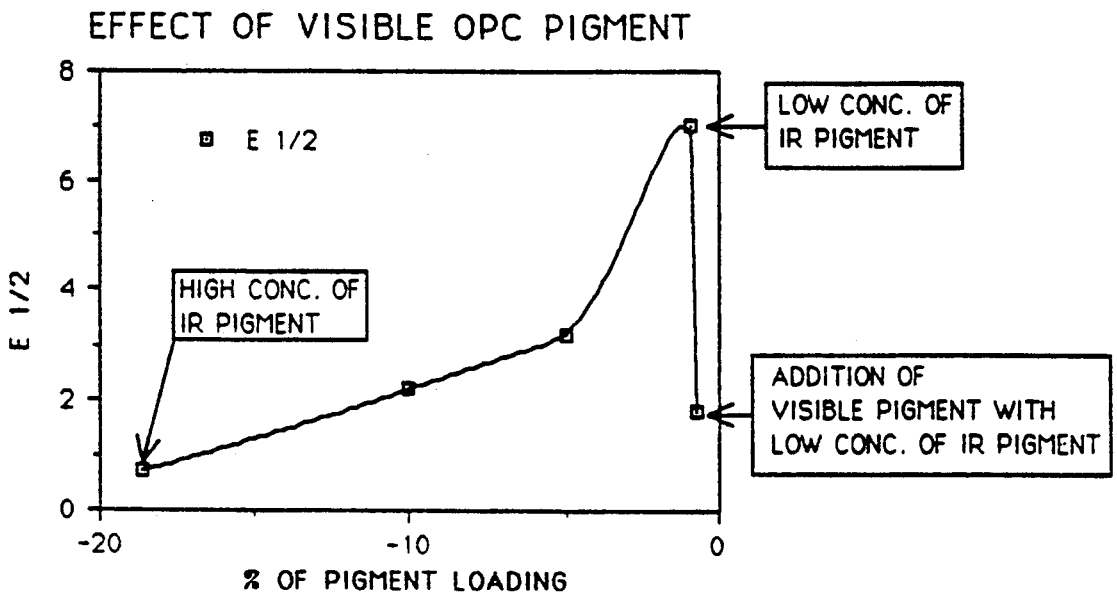

PHOTOCONDUCTIVE COMPOSITION

FIELD OF THE INVENTION

The invention pertains to a photoconductive composition useful in the fabrication of digital, laser-imaged offset printing plates. More particularly, the invention relates to low cost, photoconductive compositions exhibiting high sensitivity in the infrared ("IR") wavelength range, while containing very low amounts of the expensive IR-sensitive organic photoconductor composition.

BACKGROUND OF THE INVENTION

The use of laser-imaged printing plates has become state of the art. Such plates are coated with infrared-sensitive organic photoconductors sensitive to light in the wavelength range of 700–900 nm. Typical inorganic photoconductors and a wide variety of organic photoconductors do not ordinarily exhibit the required sensitivity in the infrared region.

Large amounts of the infrared-sensitive organic photoconductors are ordinarily required to produce plates with the requisite level of sensitivity. However, the cost of using such large amounts of infrared-sensitive organic photoconductors makes the cost of such plates prohibitively high.

It has now been found that an effective photoconductive composition having the required sensitivity in the infrared region can be formulated with relatively modest amounts of the infrared-sensitive organic photoconductor.

DETAILED DESCRIPTION OF THE INVENTION

The present invention embodies a photoconductive composition comprising a mixture of (a) an infrared-sensitive organic photoconductor sensitive to light in the wavelength range of 700–900 nm and present in an amount of about 0.1.2 wt. %;

(b) a visible light-sensitive organic photoconductor sensitive to light in the wavelength range of 400–700 nm and present in an amount of about 1--20 wt. %, the ratio of the visible light-sensitive organic photoconductor to the infrared-sensitive organic photoconductor being in the range of about 8:1.200:1;

(c) an ultraviolet-sensitive organic photoconductor sensitive to light in the wavelength range of 300–400 nm and present in an amount of about 10.20 wt. %; and (d) a binder, present in an amount of about 60–85 wt. %.

Preferably, the infrared-sensitive organic photoconductor is present in an amount of 0.5–1 wt. % and the ratio of the visible light-sensitive organic photoconductor to the infrared-sensitive organic photoconductor is in the range of 20:1–200:1.

The preferred infrared-sensitive organic photoconductor is an anthraquinone dye or phthalocyanine. A particularly preferred infrared-sensitive organic photoconductor is C.I. Vat Brown 22 having the formula:

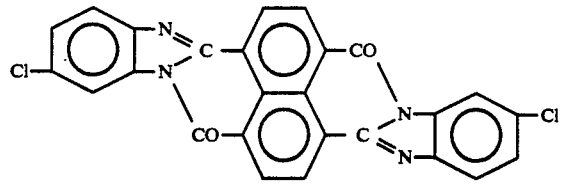

The phthalocyanines of the following structure are also useful infrared-sensitive organic photoconductors:

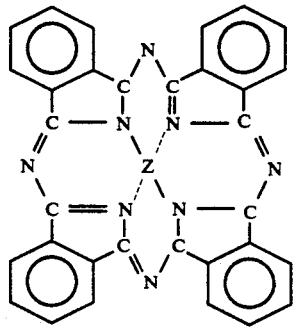

wherein Z is selected from the group consisting of $H_2$, Ti=O, V=O, Al-13 Cl, Mg—Cl and Cu—Cl.

Preferably, the visible light-sensitive organic photoconductor comprises C.I. Pigment Orange 43 having the formula

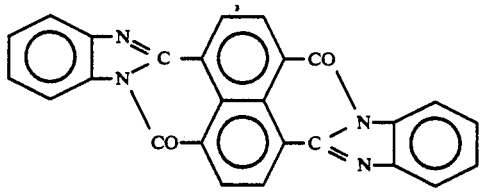

Alternatively, the visible light-sensitive organic photoconductor may be an anthanthrone compound having the formula

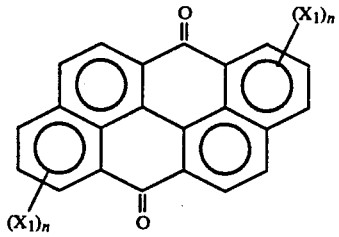

wherein $X_1$and $X_2$ are the same or different halogen atoms and n is an integer of 0 to 4.

Preferably, the ananthrone compound is Monolyte Red 2Y, also known as C.I. Pigment Red 168, having the formula:

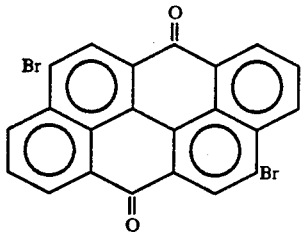

The ultraviolet-sensitive organic photoconductor comprises an oxadiazole compound such as any of those described in U.S. Pat. No. 4,868,079. The preferred oxadiazole comprises 2,5-bis(4-diethyl. aminophenyl)-1,3-4-oxadiazole having the formula:

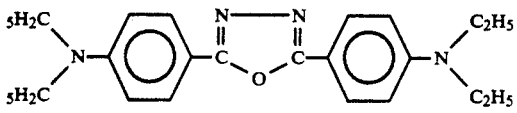

The ultraviolet-sensitive organic photoconductor may also be a triphenyl methane compound, especially one having the formula:

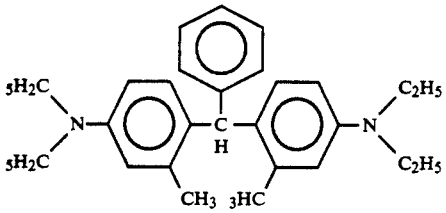

The binder may be any resin commonly employed in electrographic materials. Examples of suitable binder resins include acrylic resins, polyester resins, polycarbonate resins, polystyrene resins, phenolic resins, epoxy resins, urethane resins, phenoxy resins, styrene-butadiene copolymers, silicone resins, styrene-alkyd resins, soya-alkyd resins, polyvinylchloride, polyvinylidene chloride, ketone resins, polyamide resins, etc.

The photoconductive compositions of the present invention will typically have a speed, $E_{\frac{1}{2}}$, of less than about 2 and a residual voltage, $V_R$, of less than about 50 V. $E_{\frac{1}{2}}$ was measured using a 788 nm filter, 1 lux light source, on a Model SP-428 Kawaguchi Electrostatic Paper Analyzer.

This invention will be better understood with reference to the following example; unless otherwise indicated, all parts and percentages are on a weight basis.

EXAMPLE 1

Several photoconductive compositions were prepared with the components described in the following Table I:

TABLE I

| | Compositions (Wt. %) | | | | | | |
|---|---|---|---|---|---|---|---|
| Ingred. | A | B | C | D | E | F | G |
| Binder | 71.0 | 69.0 | 68.9 | 83.8 | 70.8 | 78.4 | 71.0 |
| UV | 12.9 | 13.8 | 12.5 | 15.2 | 12.9 | 15.7 | 12.9 |
| Vis #1 | 16.3 | | | | 15.7 | | 14.5 |
| IR #1 | | | 18.6 | 0.93 | 0.63 | | |
| IR #2 | | | | | | 5.88 | 1.61 |

TABLE I-continued

| | Compositions (Wt. %) | | | | | | |
|---|---|---|---|---|---|---|---|
| Ingred. | A | B | C | D | E | F | G |
| Vis #2 | | 17.2 | | | | | |

binder = vinyl acetate copolymer
UV = 2,5-bis(4-diethylaminophenyl)-1,3-4-oxadiazole
Vis #1 = C.I. Pigment Orange 43
IR #1 = C.I. Vat Brown 22
IR #2 = X-form metal-free phthalocyanine
Vis #2 - Monolyte Red 2Y Compositions A–G were tested for speed, $E_{\frac{1}{2}}$, and residual voltage, $V_R$; their values are presented in Table II below:

TABLE II

| Compostions | $E_{\frac{1}{2}}$ | $V_R$ |
|---|---|---|
| A | ∞ | 262.5 |
| B | ∞ | 181.3 |
| C | 0.7 | 12.5 |
| D | 7.0 | 214.8 |
| E | 1.8 | 31.3 |
| F | 2.0 | 50.0 |
| G | 1.8 | 25.0 |

As may be seen from Table II, compositions C, E and G exhibited $E_{\frac{1}{2}}$ values of less than 2.0 and $V_R$ values of less than 50 and were therefore satisfactory. Note that composition C, however, achieved such values with the use of a high level of IR pigment (18.6 wt. %) with no visible pigment being present. On the other hand, composition E achieved satisfactory results with only 0.63 wt. % IR pigment and 15.7 wt. % visible pigment present while composition G achieved satisfactory results with 1.61 wt. % of a different IR pigment and 14.5 wt. % of the same visible pigment. The advantage of incorporating the relatively cheap visible pigment with the expensive IR pigment is clearly shown in the case of composition D in which the IR pigment content was 0.93 wt. % (higher than in composition E), but no visible pigment was present.

In the accompanying FIGURE, the $E_{\frac{1}{2}}$ values (abscissa) for the compositions were plotted versus the pigment loading, in wt. %, of the infrared-sensitive organic photoconductor (ordinate). Composition C is shown at the extreme left ("high conc. of IR pigment"), with composition D shown on the right at the highest point on the ordinate ("low conc. od IR pigment") and composition E is shown at the extreme right ("addition of visible pigment with low conc. of IR pigment"). Intermediate points, at 10 wt. % and 5 wt. % IR pigment loadings, are also shown on the curve, but are not stated in Table I or Table II.

What is claimed is:

1. A photoconductive composition comprising a mixture of:

(a) an infrared-sensitive organic photoconductor present in an amount of about 0.1–2 wt. %, comprising C.I. Vat Brown 22 having the formula:

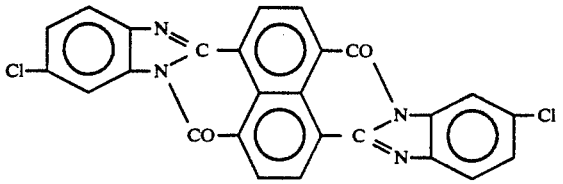

(b) a visible light-sensitive organic photoconductor sensitive to light in the wavelength range of 400–700 nm and present in ana mount of about 10–20 wt. %, the ratio of the visible light-sensitive organic photoconductor to the infrared-sensitive organic photoconductor being in the range of about 8:1–200:1;

(c) an ultraviolet-sensitive organic photoconductor sensitive to light in the wavelength range of 300–400 nm and present in an amount of about 10–20 wt. %; and (d) a binder, present in an amount of about 60–85 wt. %.

2. The composition of claim 1 wherein the infrared-sensitive organic photoconductor is present in an amount of 0.5–1 wt. %.

3. The composition of claim 1 wherein the ratio of the visible light-sensitive organic photoconductor to the infrared-sensitive organic photoconductor is in the range of 20:1–200:1.

4. The composition of claim 1 wherein the visible light-sensitive organic photoconductor comprises C.I. Pigment Orange 43 having the formula:

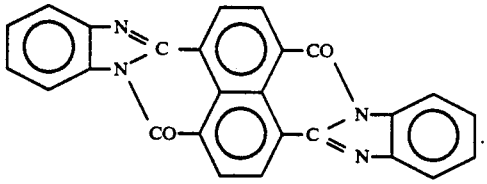

5. The composition of claim 1 wherein the visible light-sensitive photoconductor comprises an anthanthrone compound having the formula:

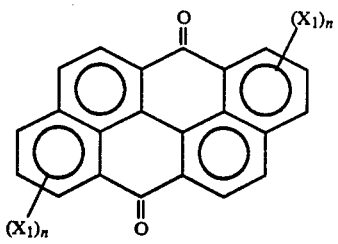

wherein $X_1$ and $X_2$ are the same or different halogen atoms and n is an integer of 0 to 4.

6. The composition of claim 5 wherein the ananthrone compound comprises Monolyte Red 2Y having the formula:

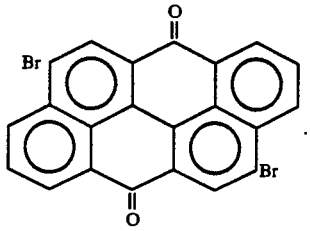

7. The composition of claim 1 wherein the ultraviolet-sensitive organic photoconductor comprises an oxadiazole compound.

8. The composition of claim 7 wherein the oxadiazole compound comprises 2,5-bis(4-diethylaminophenyl)-1,3-4-oxadiazole having the formula:

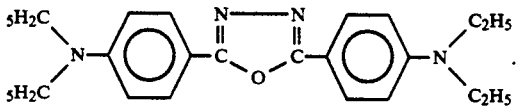

9. The composition of claim 1 wherein the ultraviolet-sensitive organic photoconductor comprises a triphenyl methane compound.

10. The composition of claim 9 wherein the triphenyl methane compound has the formula:

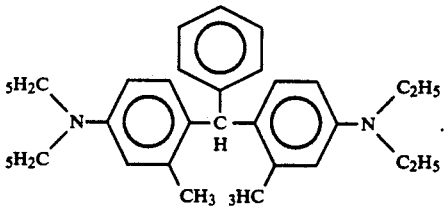

* * * * *